US011384619B2

(12) United States Patent
Cheng et al.

(10) Patent No.: US 11,384,619 B2
(45) Date of Patent: Jul. 12, 2022

(54) CASING HANGER ACTUATED LOAD SHOULDER

(71) Applicant: Baker Hughes Oilfield Operations LLC, Houston, TX (US)

(72) Inventors: Samuel H. Cheng, Katy, TX (US); Joseph W. Pallini, Tomball, TX (US); Shakib Amini, Houston, TX (US); Daryl Attaway, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/666,893

(22) Filed: Oct. 29, 2019

(65) Prior Publication Data

US 2021/0123315 A1 Apr. 29, 2021

(51) Int. Cl.
*E21B 33/04* (2006.01)

(52) U.S. Cl.
CPC ..... *E21B 33/04* (2013.01); *E21B 33/0407* (2013.01); *E21B 33/0422* (2013.01)

(58) Field of Classification Search
CPC .... E21B 33/04; E21B 33/047; E21B 33/0422; E21B 33/0353
See application file for complete search history.

(56) References Cited

U.S. PATENT DOCUMENTS 4,595,063 A 6/1986 Jennings
4,836,579 A * 6/1989 Wester ..... E21B 33/04 285/3
5,209,521 A * 5/1993 Osborne ..... E21B 33/04 285/123.3
5,240,076 A * 8/1993 Cromar ..... E21B 33/04 166/382
5,638,903 A 6/1997 Kent
(Continued)

FOREIGN PATENT DOCUMENTS

EP 2518260 10/2012
WO 2016/085620 6/2016

OTHER PUBLICATIONS

W.S. Cowan, "Independent Load Support in an 18 3/4-in., 15,000-psi Subsea Wellhead," Mar. 1993, Society of Petroleum Engineers, pp. 64-68.

(Continued)

*Primary Examiner* — Nicole Coy
(74) *Attorney, Agent, or Firm* — Hogan Lovells US LLP

(57) ABSTRACT

A wellhead system includes a first position casing hanger and a second position casing hanger, arranged within a wellbore. The second position casing hanger is positioned axially higher and stacked on the first position casing hanger, and a weight of the second position casing hanger is supported, at least in part but less than entirely, by the first position casing hanger and, at least in part but less than entirely, by an actuated load shoulder transferring the force into a high pressure housing. The actuated load shoulder includes a load ring having a hanger side profile and a housing side profile, the load ring is adapted to engage a hanger profile formed in the second position casing hanger and a housing profile formed in the high pressure housing upon activation via the first position casing hanger.

20 Claims, 9 Drawing Sheets

(56) References Cited

U.S. PATENT DOCUMENTS

| | | | | |
|---|---|---|---|---|
| 7,380,607 | B2 * | 6/2008 | Thomas | E21B 33/038 166/208 |
| 7,900,706 | B2 | 3/2011 | Ford | |
| 8,413,730 | B2 * | 4/2013 | Gette | E21B 33/04 166/382 |
| 8,813,837 | B2 * | 8/2014 | Gette | E21B 33/0422 166/82.1 |
| 8,851,182 | B2 | 10/2014 | Nguyen | |
| 2005/0274526 | A1 | 12/2005 | Thomas | |
| 2006/0016604 | A1 | 1/2006 | Ford | |
| 2014/0284048 | A1 * | 9/2014 | Gette | E21B 33/04 166/208 |

OTHER PUBLICATIONS

International Search Report and Written Opinion dated Feb. 2, 2021 in corresponding PCT Application No. PCT/US2020/056032.

* cited by examiner

CASING HANGER ACTUATED LOAD SHOULDER

BACKGROUND

1. Field of Invention

This disclosure relates in general to oil and gas tools, and in particular, to systems and methods for downhole wellbore systems utilizing stacked casing configurations.

2. Description of the Prior Art

In a downhole well, such as an oil and gas well, a wellhead may be positioned at a surface location, which may be a ground surface or a subsea floor for a subsea well. The wellhead may include an annular bore that receives wellbore tubulars. In certain embodiments, the wellbore is a cased wellbore that includes a casing string. At least one load shoulder is usually disposed within the bore for supporting the casing string. In deep wells, there will generally be more than one casing string extending into the well, and one or more load shoulders may be provided for supporting each one of the casing strings. Often, once a well is drilled to a certain depth, a first casing string is lowered through the bore of the wellhead and supported by a first casing hanger on a first load shoulder in the wellhead, the casing may then be cemented in place. Subsequent casing strings may be added to the well, below the first casing string, where a second casing hanger is supported by the first casing hanger, a third casing hanger is supported by the second casing hanger, and so on. Often, the entire weight of the second casing string and second casing hanger is transmitted through the first casing hanger to the first load shoulder. Moreover, loads from above, such as pressure testing loads, are also transmitted to the first load shoulder. Accordingly, the limiting factor within the well is the first load shoulder and/or the first casing hanger.

SUMMARY

Applicant recognized the problems noted above herein and conceived and developed embodiments of systems and methods, according to the present disclosure, for downhole wellbore operations.

In an embodiment, a wellhead system includes a first position casing hanger, arranged within a wellbore, the first position casing hanger supported, at least in part, by a load member. The wellhead system also includes a second position casing hanger, arranged within the wellbore, the second position casing hanger positioned axially higher and stacked on the first position casing hanger, a weight of the second position casing hanger supported, at least in part but less than entirely, by the first position casing hanger and, at least in part, by an actuated load shoulder transferring the force into a high pressure housing, the actuated load shoulder including a load ring having a hanger side profile and a housing side profile, the load ring adapted to engage a hanger profile formed in the second position casing hanger and a housing profile formed in the high pressure housing upon activation via the first position casing hanger, the load ring being driven toward the high pressure housing via a force applied to a contact surface arranged at a first angle, the force driving the load ring toward the hanger profile along a hanger groove arranged at a hanger groove angle, wherein the first angle is less than a housing groove angle of the housing profile.

In another embodiment, a wellhead system includes a housing positioned within a wellbore, the housing including a housing profile formed, at least in part, by a plurality of housing profile grooves. The system also includes a first position casing hanger, arranged within a wellbore, the first position casing hanger supported, at least in part, by a load member. The system further includes a second position casing hanger, arranged within the wellbore, the second position casing hanger positioned axially higher and stacked on the first position casing hanger, the second position casing hanger including a hanger profile formed, at least in part, by a plurality of hanger profile grooves. The system also includes a load ring adapted to move radially outward from the second position casing hanger. The load ring includes a hanger side profile having a plurality of hanger side profile grooves, at least a portion of the hanger side profile grooves aligning with at least a portion of the hanger profile grooves. The load ring also includes a housing side profile having a plurality of housing side profile grooves, at least a portion of the housing side profile grooves aligning with at least a portion of the housing profile grooves when the load ring is in an activated position. The load ring further includes a contact surface positioned at a lower region of the load ring, the contact surface arranged at a contact surface angle, the contact surface angle adapted to receive a reaction force based least in part, on downward movement of the second position casing hanger, relative to the first position casing hanger. In embodiments, at least a portion, but less than an entirety, of a weight of the second profile casing hanger is supported by the housing when the load ring is in the activated position, the load ring being moved into the activated position via engagement between the first position casing hanger and the second position casing hanger, the contact surface receiving the reaction force and driving movement of the load ring in an axial direction toward the hanger grooves arranged at respective hanger groove angles and radially toward the housing profile, the housing profile grooves arranged at respective housing groove angles greater than the contact surface angle.

In an embodiment, a method for arranging a stacked hanger configuration includes providing a second position casing hanger having an actuated load shoulder, the actuated load shoulder including a load ring that moves between a retracted position and an activated position. The method also includes positioning the second position casing hanger, within a wellbore, proximate a housing profile formed in a high pressure housing, the second position casing hanger being axially uphole from a first position casing hanger. The method further includes engaging a shoulder of the first position casing hanger, via the second position casing hanger, to drive the load ring radially outward from the second position casing hanger, the load ring receiving a driving force along an angled contact surface. The method also includes engaging the housing profile, via the load ring, when the load ring is in the activated position.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
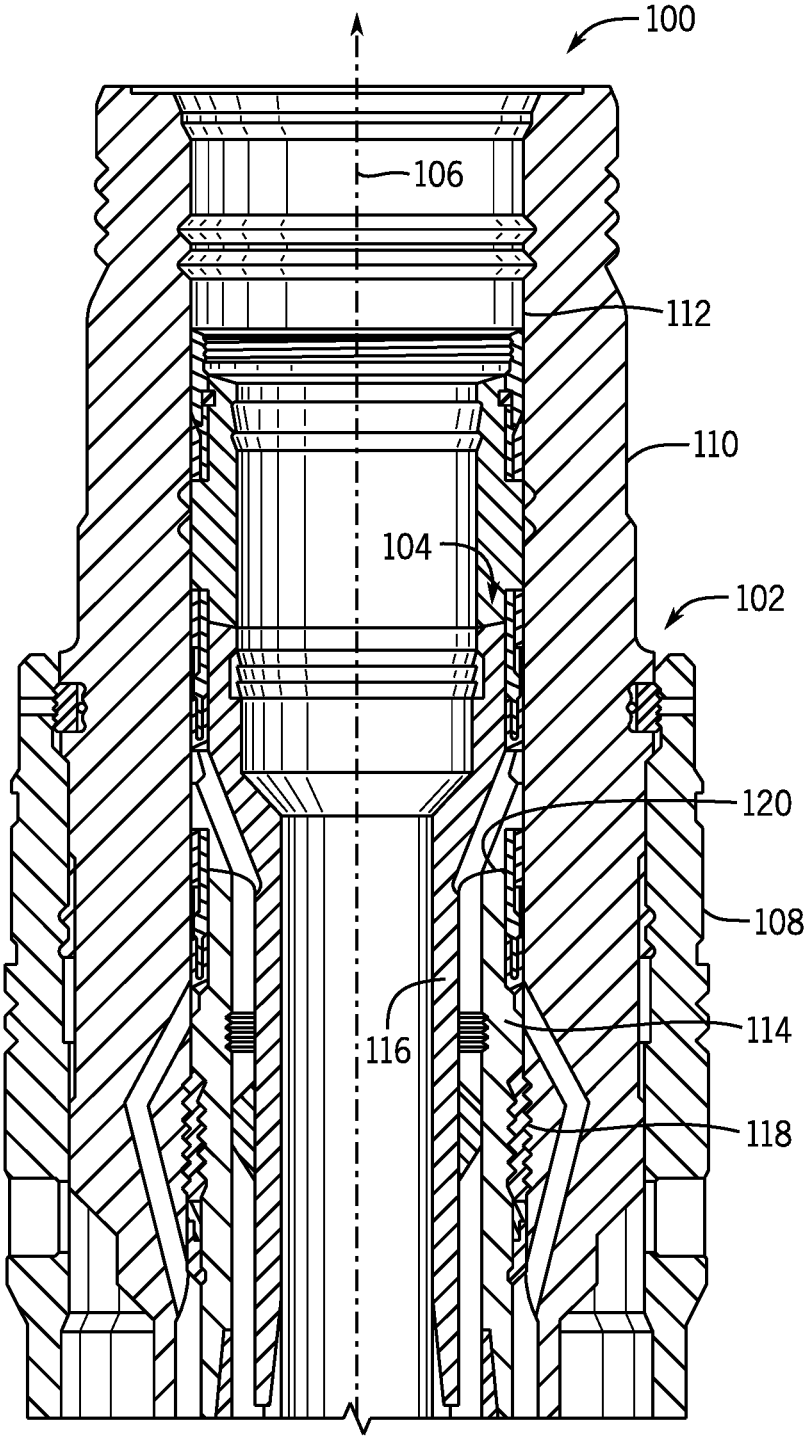
FIG. 1 is a schematic cross-sectional view of an embodiment of wellhead system including a stacked casing hanger configuration, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward an actuated load shoulder that utilizes a combination of at least three different tapers, in combination with one another, in order to transmit at least a portion of, but not all of, a weight of a casing hanger between a lower casing hanger and an outer housing. In embodiments, at least two casing hangers are stacked in a wellbore, however, it should be appreciated that any number of casing hangers may be stacked, such as 3, 4, 5, 6, or any other reasonable number. A downhole or first casing hanger may be used, at least in part, to actuate a load ring associated with an uphole or second casing hanger. The load ring may be arranged with an annular pocket formed in the second casing hanger. In various embodiments, the load ring includes groove profiles on both a hanger side and a housing side that mate with respective hanger profiles and housing profiles. In operation, a lower surface of the load ring may contact a plunger, which applies a reactive force that drives the load ring in an upward and radially outward direction. The housing side groove profile may engage the housing profile as the load ring receives the reactive force. As the second hanger continues to move in a downward direction (opposite the movement of the load ring), the load ring may engage both the hanger profile and the housing profile, thereby transferring forces between both the first hanger and the housing. As will be described below, respective angles associated with the lower surface, hanger profile, housing profile, and groove profiles may be particularly selected in order to transmit different portions of the force within the system, as well as to lock or otherwise secure the load ring into position.

Embodiments of the present disclosure are directed toward actuating a second casing hanger load shoulder (e.g., upper casing hanger, higher casing hanger, upstream casing hanger, etc.) in a subsea wellhead, however it should be appreciated that embodiments may be equally applicable to surface wells and that subsea wells are shown for illustrative purposes only. In various embodiments, the second casing hanger load shoulder enables the second casing hanger to hang more casing, and handle higher pressure end loads from above, than a stacked hanger configuration. The casing loads are shared between a high pressure housing and a hanger neck below it (e.g., downhole, downstream, etc.), which allows other casing hanger positions of the stack to hang more casing and handle higher pressure end loads from above. In various embodiments, a segmented load ring is actuated using a hanger neck below, for example a hanger neck of a first casing hanger. The load of the casing hanger is shared between the first position casing hanger and the segmented ring, which transmits at least a portion of the load into a housing. The casing hanger may further include retention and retrieval mechanisms that allow the segments to be retracted and held with a single upwards pull of the casing hanger. As a result, removal may be easier. In various embodiments, the segmented load ring is actuated on the load shoulder on the hanger neck below it and then shares the load between the high pressure housing and the casing hanger below it. For example, the segmented load ring may engage the high pressure housing to transfer at least a portion of the force to the high pressure housing. In various embodiments, the trip shoulder or activation shoulder is not formed on the high pressure housing, and as a result, the second casing hanger may be deployed at a variety of different locations within the wellhead without aligning with a particular region of the wellhead.

Embodiments of the present disclosure may overcome one or more deficiencies associated with stacked subsea wellhead configurations (or surface configurations, as noted above). In a stacked wellhead configuration, a second position (or higher) casing hanger may land on a first position (or lower) casing hanger below it. The total weight of the stack, along with the pressure end load from above, is supported entirely or substantially entirely by the first position casing hanger. However, as deeper and high pressure wells are drilled, heavier casing strings are utilized and supported, along with increases in pressure end loads. Accordingly, hanging capacity needs to increase in order to support the demands of these higher pressure and higher temperature wellheads. Unfortunately, traditional systems may transmit substantially all of the load onto the first position hanger, which may be supported by an expandable load ring, which may be considered the limiting factor. Embodiments of the present disclosure are utilized to direct forces away from the first position hanger and into a housing, which enables larger and heavier casing strings.

Embodiments of the present disclosure include a load ring that may be actuated between a stored position and an activated position via a plunger or other driving mechanism. In an embodiment, the plunger may be driven against a first position casing hanger as a second position casing hanger is moved in downward direction into a wellbore. The plunger may apply a force to the load ring that drives the load ring in an upward direction. The load ring may contact a profile formed in the second position casing hanger that transmits at least a portion of the force into a radial force to drive the load ring radially outward and into contact with a high pressure housing, such as with an associated profile formed in the high pressure housing. As a result, load may be shared between the first position casing hanger and the high pressure housing. Described herein are embodiments where one or more features may be adjusted in order to facilitate different proportions of load distribution between the load ring and the first position casing hanger. For example, one or more grooves or shoulders may be arranged at an angle that may be adjusted in order to change force distribution within the system. In this manner, larger or more casing hangers may be stacked within the well bore.

In various embodiments, respective angles of the components of the system may be particularly selected to both direct force transmissions within the system as well as to prevent inadvertent movement of shifts, while also providing adequate clearance to accommodate misalignment and the like. For example, an angle associated with a lower portion of the load ring, where the load ring receives the reactive force, may be shallower than an angle associated with the hanger profile. As will be described below, various forces and reactive forces are utilized in order to position and then hold the load ring in place, and as a result, adjustment of the angles and other dimensions within the system of the present disclosure may be particularly selected based on expected operating conditions.

FIG. 1 is a schematic cross-sectional view of an embodiment of a wellhead system 100 that includes a housing assembly 102 and a stacked casing hanger configuration 104. The illustrated wellhead system 100 includes a longitudinal axis 106, however, it should be appreciated that the configuration illustrated is for illustrative purposes only and that the wellhead may be arranged at an angle or may include portions that are deviated. The illustrated system includes an outer housing 108 and a high pressure housing 110, which may also be preferred to as a high pressure wellhead. An axial bore 112 extends along the longitudinal axis 106 and receives the stacked casing hanger configuration 104, which includes a first casing hanger assembly 114 and a second casing hanger assembly 116.

In the illustrated embodiment, the first casing hanger assembly 114 may also be referred to as a first position casing hanger 114 (e.g., first casing hanger), and the second casing hanger assembly 116 may also be referred to as a second position casing hanger 116 (e.g., second casing hanger). As illustrated, the first position casing hanger 114 is arranged downhole or below the second position casing hanger 116. The second position casing hanger 116 may be referred to as being "stacked" on the first position casing hanger 114. In operation, the weight of the second position casing hanger 116 is supported by the first position casing hanger 114. Only two casing hanger assemblies are disclosed herein for simplicity, but it should be appreciated that multiple casing hanger assemblies may be utilized and further stacked on one another. For example, 3, 4, 5, 6, 7, or any reasonable number of casing hanger assemblies may be utilized. Accordingly, while first and second position hangers may be described herein, similar operations may also be applicable between the second and a third position casing hanger, and so on.

The first position casing hanger 114 engages the high pressure housing 110 via a load member 118, which may be activation ring or the like. The load member 118 may be activated by one or more features of the high pressure housing 110, such as along a load shoulder or the like. It should be appreciated that various components are not described herein for simplicity with the following discussion and that additional features may be included to facilitate supporting the first position casing hanger 114, activating the load member 118, permitting flow by for operational purposes, and the like.

In the illustrated embodiment, the first position casing hanger 114 includes a shelf 120 for supporting the second position casing hanger 116. As will be described below, in various embodiments, the shelf 120 may be used to activate an expanding load shoulder associated with the second position casing hanger 116.

Figure 2:
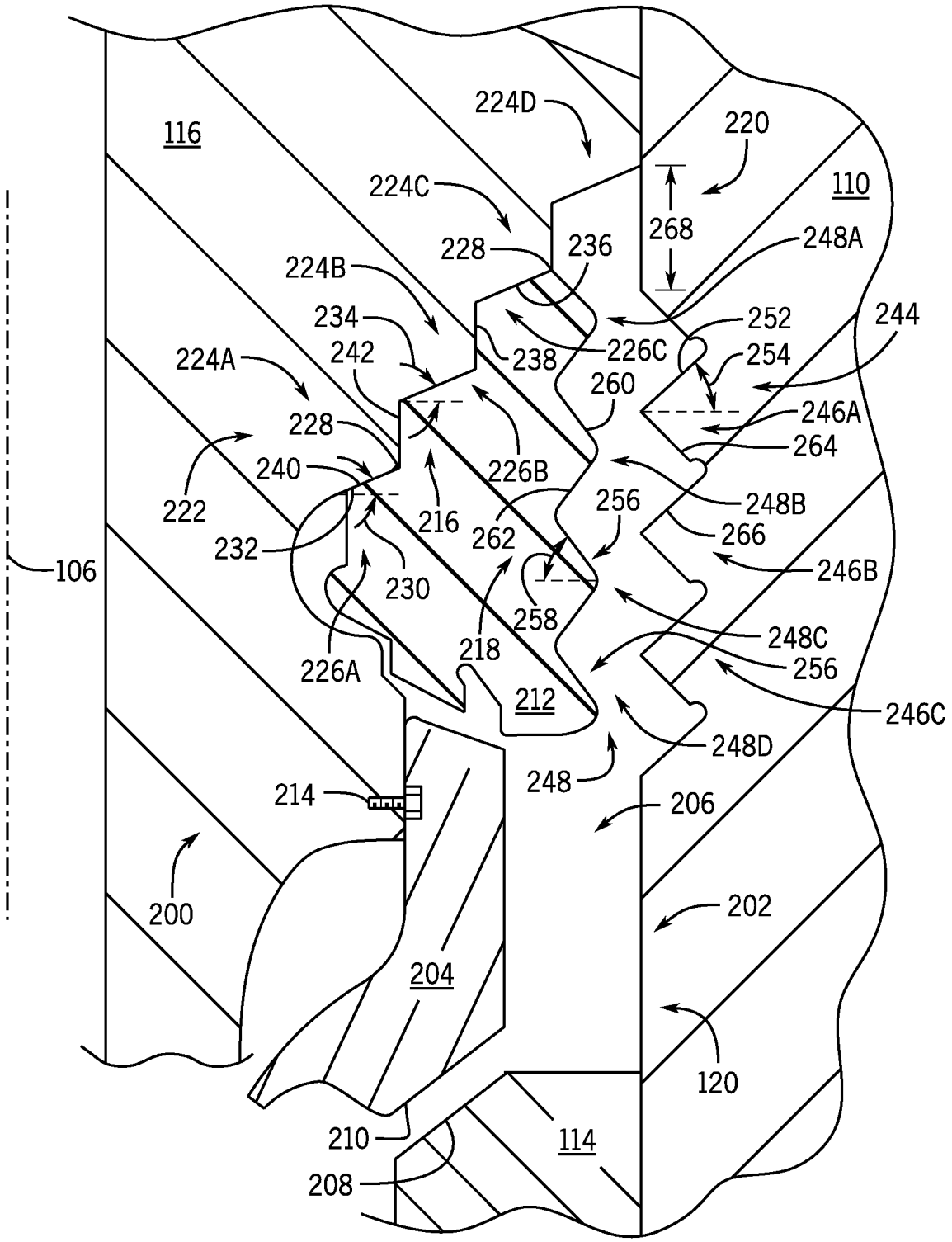
FIG. 2 is a schematic cross-sectional view of an embodiment of an actuated load shoulder in a retracted position, in accordance with embodiments of the present disclosure.

FIG. 2 is a detailed schematic cross-sectional view of an embodiment of an actuated load shoulder 200 utilized to transmit at least a portion of the load, but in embodiments not all of the load, of the second position casing hanger 116 to the high pressure housing 110. As a result, a reduced load is placed on the first position casing hanger 114, which enables larger and heavier casing hangers to be suspended within the wellbore. The illustrated embodiment includes the first position casing hanger 116 arranged axially lower, along the axis 106, than the second position casing hanger 116. Both the first position casing hanger 114 and the second position casing hanger 116 are positioned within the high pressure housing 110. As will be described below, in operation, downward movement of the second position casing hanger 116 activates a load ring to engage with a profile formed in the high pressure housing 110. As noted above, the present disclosure is described with reference to the first and second position casing hangers 114, 116, but it should be appreciated that there may be more casing hangers stacked within the wellbore. The arrangement of only two is for illustrative purposes only and for clarity and conciseness, and it should be appreciated that operation between the first and second position casing hangers 114, 116 may be equally applicable to operation between a third position casing hanger and the second position casing hanger, a fourth position casing hanger and the third position casing hanger, and so forth.

The illustrated embodiment includes an upper portion 202 of the first position casing hanger 114 positioned proximate a plunger 204 coupled to the second position casing hanger 116. The upper portion 202 includes the shelf 120, positioned axially downhole from a seal space 206, and further includes a slanted portion 208. The plunger 204 includes an activation surface 210 that engages the slanted portion 208, in operation, to drive a load ring 212 into engagement with the high pressure housing 110. As shown, the plunger 204 may be coupled to the second position casing hanger 116, for example via shear pins 214, such that a force that exceeds a threshold amount causes the pins 214 to break to facilitate movement between the second position casing hanger 116 and the plunger 204. In the illustrated embodiment, the actuation surface 210 substantially conforms to the slanted portion 208 to facilitate engagement of the load ring 212 via the plunger 204. It should be appreciated that the relative angles of the activation surface 210 and the slanted portion 210 are for illustrative purposes only, and that in various embodiments the angles may be shallower or steeper and may be particularly selected based on operating conditions.

Further illustrated in FIG. 2 is the load ring 212 arranged along a portion of the second position casing hanger 116. The load ring 212 includes a hanger side profile 216 and a housing side profile 218. In the illustrated embodiment, the hanger side profile 216 is different from the housing side profile 218. For example, the hanger side profile 216 may have a different number of steps, be arranged at difference angles, have different thicknesses, have different lengths, and the like. However, it should be appreciated that one or more features of the profiles may be substantially aligned or the same. In embodiments, the load ring 212 is arranged within a pocket 220 formed in the second position casing hanger 116. The pocket 220 may be an annular pocket that extends substantially around the second position casing hanger 116. The load ring 212 may be arranged to have an interference fit with at least a portion of the pocket 220 such that the load ring 212 is maintained within the pocket 220 until an activation force, such as from the plunger 204, drives the load ring 212 radially outward from the pocket 220. Moreover, in embodiments, a split ring may be arranged within the illustrated relief in order to facilitate expansion and retraction of the load ring 212. In embodiments, at least a portion of the load ring 212 may remain within at least a portion of the pocket 220, even when deployed. The load ring 212 is illustrated as being in a stored position in the illustrated embodiment of FIG. 2. Accordingly, the second position casing hanger 116 may be tripped into the wellbore without having the load ring 212 contact other components, which would make it more difficult to install.

In the illustrated embodiment, the hanger side profile 216 of the load ring 212 substantially corresponds to a hanger profile 222 such that the load ring 212 is arranged at least partially along the hanger profile 222. While direct engagement is illustrated in FIG. 2, it should be appreciated that gaps or the like may be present along the respective interface between the hanger side profile 216 and the hanger profile 222 to accommodate misalignment or the like, and as a result, a flush fit between the respective profiles 216, 222 may not be present in each embodiment. The illustrated hanger profile 222 includes a plurality of grooves 224 (e.g., hanger grooves 224) that include respective peaks and troughs. Similarly, the hanger side profile 216 includes a plurality of grooves 226 (e.g., hanger side grooves 226), also formed by respective peaks and troughs. In the illustrated embodiment, there are four hanger grooves 224 and three hanger side grooves 226, but in other embodiments there may be more or fewer grooves 224, 226. For clarity with the following discussion, the grooves may be referred to by accompanying letter identifiers, for example, hanger grooves 224A-D and hanger side grooves 226A-C. In the illustrated embodiment, corresponding grooves are aligned (e.g., hanger groove 224A is aligned with hanger side groove 226A). As will be described below, the plunger 204 may drive movement of the load ring 212 to adjust a position of the respective grooves 226 of the load ring 212.

In various embodiments, each hanger groove 224 may form a respective shoulder 228 that is arranged at a respective angle 230 (e.g., hanger groove shoulder angle). It should be appreciated that the angles 230 may be adjusted, which may change how loads are transferred within the system. As a result, the system can be tuned to transmit more or less force to the high pressure housing 110. The illustrated angles 230 of the hanger grooves 224 are substantially equal in the illustrated embodiment. However, it should be appreciated that the angles 230 may be different and particularly selected based on operating conditions and the like. For example steeper angles (e.g., less flat shoulders 228), may facilitate more movement of the load ring 212. Moreover, as will be described below, the angles may further be sized based on other angles or surfaces within the system to accommodate and adjust for reactive forces throughout the system.

As discussed, the load ring 212 includes the hanger side profile 216 having the hanger side grooves 226. The hanger side grooves 226 include respective faces 232 that interact with and may contact the shoulders 228 of the hanger grooves 224. These faces 232 are arranged at respective angles 234, where each angle 234 may be different from or the same as other angles of the hanger side profile 216. In various embodiments, the angles 230 and 234 are particularly selected to conform to one another, thereby forming a substantially tight fitting and aligned contact edge between the second position casing hanger 116 and the load ring 212. However, as noted below, in embodiments the angles may be different to facilitate gaps or spaces between the profiles 216, 222 to accommodate for misalignment and shifts in the downhole environment.

It should be appreciated that the faces 232 may include an upper or upstream face 236 and a side or downstream face 238. That is, the upper face 236 may interact with a slanted portion 240 of the hanger groove 224 while the side face 238 interacts with a planar portion 242 of the hanger groove 224. As will be described below, in operation, the plunger 204 may drive the load ring 212 in an upstream direction, due to a reactive force in response to downward movement of the second position casing hanger 116, which may translate to a force along the upstream face 236. The upstream face 236 interacts with the slanted portion 240, thereby driving radial movement of the load ring outward from the axis 106. The outward radial movement may drive the load ring 212 to engage the high pressure housing 110. As will be described below, the relative angles and arrangement between components in the system facilitate engagement and force transfer. For example, an angle of the plunger 204, with respect to the load ring 212, includes force components in both an upward, axial direction and an outward, radial direction. By adjusting the angle, different components of the force may be directed in different directions.

Turning to the housing side profile 218, the housing side profile 218 of the load ring 212 substantially corresponds to a housing profile 244 such that the load ring 212 is arranged at least partially along the hanger profile 244 when the load ring 212 is moved radially outward, as will be described below. It should be appreciated that, in the illustrated embodiment, there are four housing profile grooves 246 and four housing side grooves 248, but in other embodiments there may be more or fewer grooves 246, 248. For clarity with the following discussion, the grooves may be referred to by accompanying letter identifiers, for example, housing profile grooves 246A-D and housing side load ring grooves 248A-D. In the illustrated embodiment, corresponding grooves are configured to mesh or otherwise come together, which may include some spacing or gaps, as noted above, to accommodate for movement or misalignment.

In various embodiments, each housing profile groove 246 may form a respective shoulder 252 that is arranged at a respective angle 254 (e.g., housing profile groove shoulder angle). It should be appreciated that the angles 254 may be adjusted, which may change how loads are transferred within the system. For example, as noted above, in embodiments it may be desirable to have the angle 254 be steeper than an angle of the activation surface 210 because, upon contacting the housing 110, the load ring 212 may be subjected to a reactive force, which may attempt to drive the load ring 212 radially inward. As a result, the system can be tuned to transmit more or less force to the high pressure housing 110. The illustrated angles 254 of the housing profile grooves 246 are substantially equal in the illustrated embodiment. However, it should be appreciated that the angles 254 may be different and particularly selected based on operating conditions and the like. For example steeper angles (e.g., less flat shoulders 252), may be less susceptible to prevent upward forces.

As discussed, the load ring 212 includes the housing side profile 218 having the housing side grooves 248. The housing side grooves 248 include respective faces 256 that interact with and may contact the shoulders 252 of the housing grooves 246. These faces 256 are arranged at respective angles 258, where each angle 258 may be different from or the same as other angles of the housing side profile 218. In various embodiments, the angles 254 and 258 are particularly selected to conform to one another, thereby forming a substantially tight fitting and aligned contact edge between the high pressure housing 110 and the load ring 212. However, as noted above, there may be spaces between the housing profile 244 and the housing side profile 218 for movement due to misalignment and the like. In the illustrated embodiment, the angles 258 are steeper than the angles 234 of the hanger side grooves 226.

It should be appreciated that the faces 256 may include an upper or upstream face 260 and a lower or downstream face 262. That is, the upper face 260 may interact with a lower portion 264 of the housing grooves 246 while the lower face 262 interacts with an upper portion 266 of the housing grooves 246. In operation, an upward force may drive the upper face 260 against the lower portion 264, while a downward force may drive the lower face 262 against the upper portion 266.

The illustrated embodiment includes an example of the second position casing hanger 116 being positioned proximate the first position casing hanger 114. As shown, the plunger 204 has not engaged the first position casing hanger 114, and as a result, the load ring 212 is still arranged within the pocket 220. Upward forces on the plunger 220, for example due to downward movement of the second position casing hanger 116, will shear the pins 214 to facilitate movement of the plunger 220 with respect to the first position casing hanger 114. In various embodiments, downward movement of the second position casing hanger 116 moves the plunger 220 into contact with the first position casing hanger 114 to generate the reactive force that drives movement of the load ring 212.

For clarity with the discussion herein, components may be described with respect to their relative positions in different stages of operation of the actuated load shoulder 200. The illustrated embodiment includes various components of the actuated load shoulder 200 in a stored or transport position where the second position casing hanger 116 is being tripped or lowered into the wellbore. In this embodiment, the housing side profile 218 of the lock ring 212 is illustrated as being radially inward from the hanger groove 224D, which is illustrated a first distance 268 from the housing profile 244. Furthermore, a first hanger side groove 226A engages a first hanger groove 224A, a second hanger side groove 226B engages a second hanger groove 224B, a third hanger side groove 226C engages a third hanger groove 224C, and a fourth hanger side groove 226D is not engaged with the load ring 212. Such relative position may change during activation of the load ring 212 to move the load ring 212 radially outward toward the housing 110, as will be described below.

Figure 3:
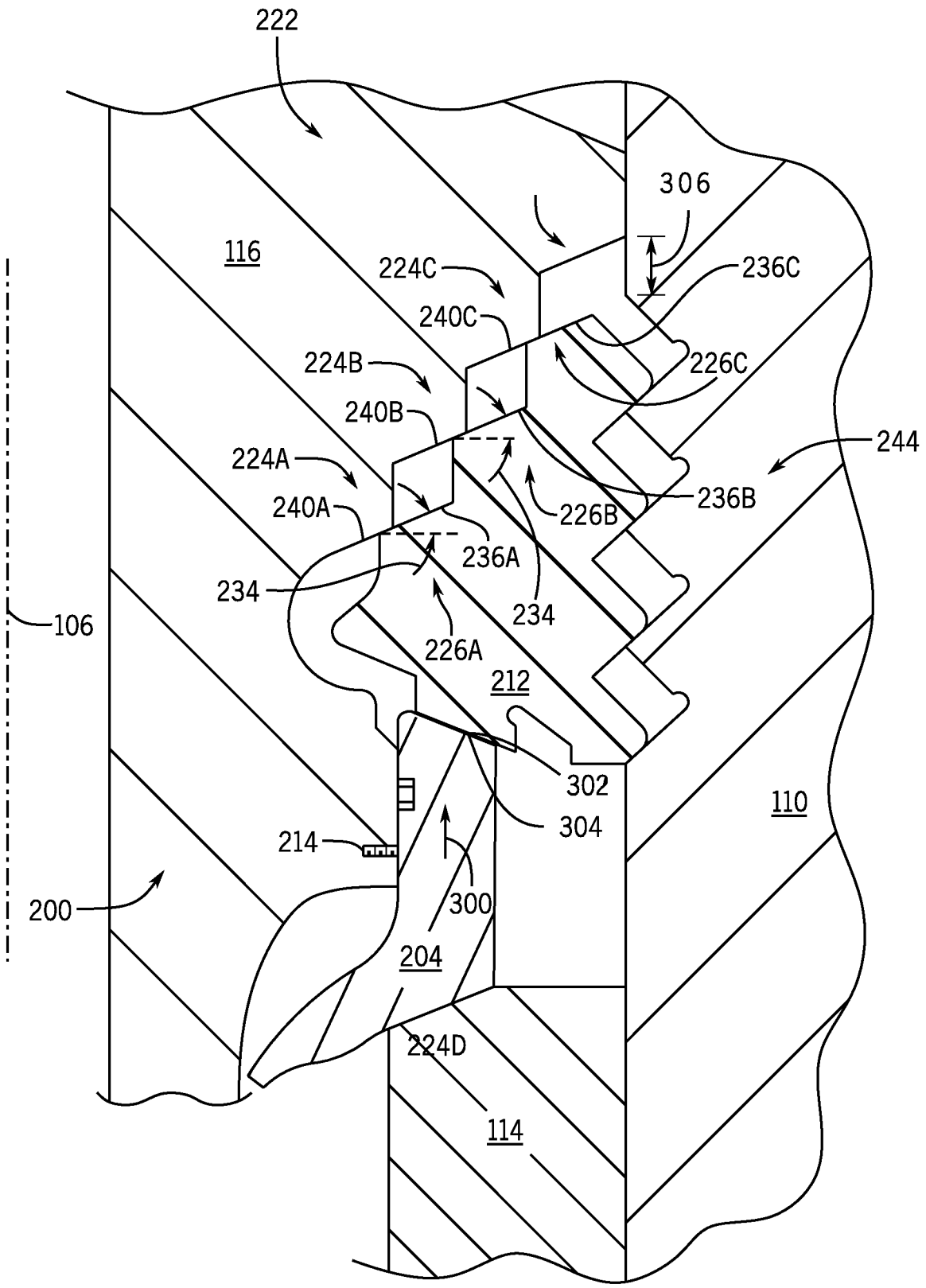
FIG. 3 is a schematic cross-sectional view of an embodiment of an actuated load shoulder in an intermediate position, in accordance with embodiments of the present disclosure.
Figure 4:
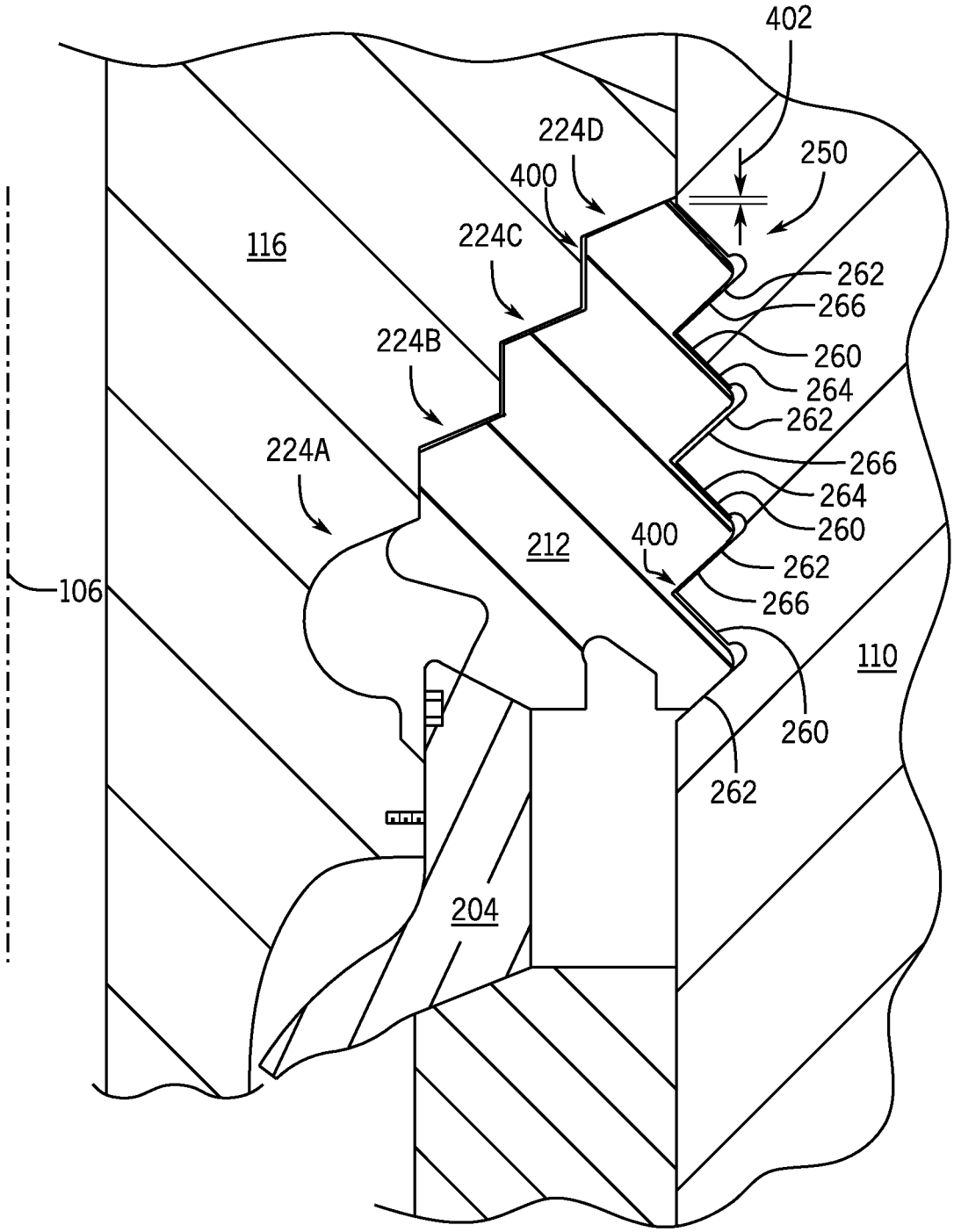
FIG. 4 is a schematic cross-sectional view of an embodiment of an actuated load shoulder in an activated position, in accordance with embodiments of the present disclosure.

FIG. 3 is a cross-sectional side view of an embodiment of the actuated load shoulder 200 in an intermediate position. The illustrated intermediate position shows the load ring 212 between a stored position (FIG. 2) and an engaged position (FIG. 4). As described above, a force 300 (illustrated as an arrow) may be transmitted to the load ring 212 via the plunger 204, which is driven against the first position casing hanger 114 due to movement of the second position casing hanger 116. In other words, the force 300 may be a reactive force that is generated via contact between the second position casing hanger 116 and the first position casing hanger 114. The plunger 204, which may be coupled to the second position casing hanger 116 in the stored position, may move relative to the second position casing hanger 116 when the coupling mechanism, illustrated as shear pins 214, break. However, the plunger 204 may also be viewed as stationary as the second position casing hanger 116 continues moving in the downward direction. The resulting force 300 is applied to the load ring 212 via contact between the plunger 204 and the load ring 212. As described above, the angles of the contact surfaces 302, 304 between the plunger 204 and the load ring 212 may be adjusted and particularly selected based on operating conditions. For example, in the illustrated embodiment, the angles are less steep than the angles of the lower portion 264. As will be appreciated, the lower portion 264, upon being contacted by the load ring 212, may have an opposite reactive force. If the angles of the contact surfaces 302, 304 were too large, then the load ring 212 would not be effective driven toward the housing 110.

The force 300 may drive the hanger side grooves 226 against the hanger grooves 224 such that the respective faces 232 engage the respective shoulders 228. Because the shoulders 228 include the slanted portion 240 and the upstream face 236 is arranged at the angle 234 (e.g., angle of the hanger side profile), a portion of the force may be redirected in a radial direction as the load ring 212 slides along the slanted portions 240, thereby moving the load ring 212 radially outward toward the housing 110. In the illustrated embodiment, the upstream face 236A moves along the slanted portion 240A, the upstream face 236B moves along the slanted portion 240B, and the upstream face 236C moves along the slanted portion 240C. This movement along the slanted portions thereby moves the housing side profile 246 toward the housing profile 244. Furthermore, in the illustrated embodiment, a second distance 306 is less than the first distance 300. As a result, the load ring 212 is transitioned toward the high pressure housing 110.

FIG. 4 is a cross-sectional side view of an embodiment of the actuated load shoulder 200 moved into an activated position in which the load ring 212 engages the high pressure housing 110. As a result, at least a portion of the weight from the second position casing hanger 116, and the force from a downward load, is transferred into the high pressure housing 110, rather than onto the first position casing hanger 114. In the illustrated embodiment, the housing profile 244 of the housing 110 engages the housing side profile 218, thereby providing a path to transfer the load from the second position casing hanger 116.

In the illustrated embodiment, the housing side grooves 248 engage, at least in part, the housing grooves 246. For example, the lower faces 262 of the housing side grooves 248 engage the upper portions 266 of respective housing grooves 246. Accordingly, a force is transmitted into the housing 110. Additionally, in embodiments, the upper faces 260 of the grooves 248 engage the lower portions 264 of the housing grooves 246. In this manner, the second position casing hanger 116 may be secured within the wellbore.

As illustrated in FIG. 4, there is clearance, represented by respective gaps 400, along both the hanger profile 222 and the housing profile 244. The clearance enables movement in either the axial or radial directions in the event of misalignment or shifting, such as a shifting plunger 204, or the like. It should be appreciated that, even with some clearance, there is still force transmission at various contact points, and accordingly, the clearance 400 provides spaces for alignment and shifting in the downhole environment.

As described, the force 300 from the plunger 204 drives the loading ring 212 upward and radially outward from the stored position. As a result, the hanger side groove 226A has moved to engage the hanger groove 224B, the hanger side groove 226B has moved to engage the hanger groove 224C, and the hanger side groove 226C has moved to engage the hanger groove 224D. Furthermore, a distance 402 between the hanger groove 224D is less than both the first distance 268 and the second distance 302.

Advantageously, the load ring 212 is not activated by the housing 110. That is, a load shoulder or other type of activation mechanism is not positioned within the wellbore, along the housing 110, in order to activate the actuated load shoulder 200. However, in various embodiments, it is desirable to deploy the actuated load shoulder 200 proximate the housing profile 244 to facilitate engagement. But, it should be appreciated that in various embodiments the housing side profile 218 may be driven into a substantially flat surface and may cut or otherwise embed into the surface.

As described above, in various embodiments, one or more of the angles or features described herein may be adjusted in order to modify how force is transmitted within the system. That is, particular angles of the hanger profile 222, housing profile 244, hanger side profile 216, and housing side profile 218 may be adjusted. By way of example only, the respective angles 230 (e.g., hanger groove shoulder angles) may be shallower than the angles 254 (e.g, housing profile groove shoulder angles). The steeper angle of the housing grooves 246 may push or otherwise apply a reactive force radially toward the second position casing hanger 116, however, the angle of the contact surfaces 302, 304 blocks this force to enable the load ring 212 to be positioned against the housing 110. Adjustment of the various angles, as described above, may alter how components of the forces are utilized within the system. For example, there is an upward force component from each of the housing 110 and the plunger 204.

Accordingly, features may be particularly selected in order to transmit and divide forces between the high pressure housing 110 and the first position casing hanger. FIGS. 5-8 include cross-sectional detailed views of the load ring 212, hanger profile 222, housing profile 244, and plunger 204, respectively. As will be described below, in various embodiments different features of the components may be adjusted in order to change how force is transferred between components of the actuated load shoulder 200, thereby distributing loads between the first position casing hanger 114 and the housing 110.

Figure 5:
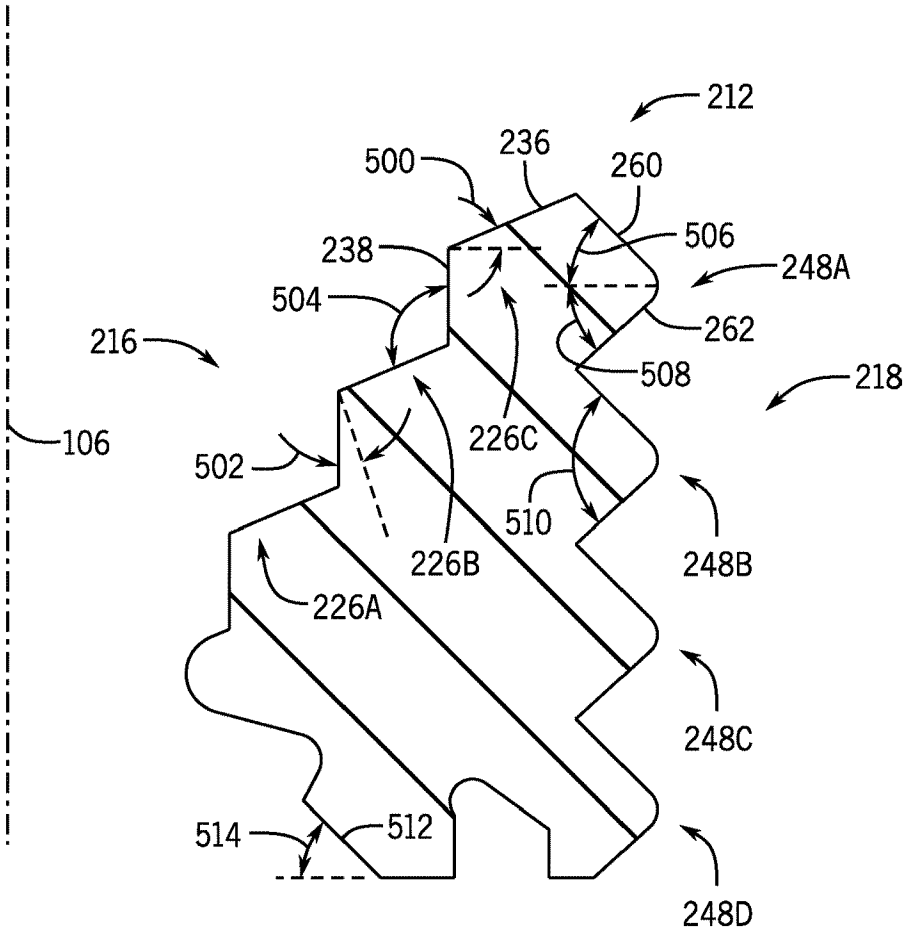
FIG. 5 is a schematic cross-sectional view of an embodiment of a load ring, in accordance with embodiments of the present disclosure.

FIG. 5 illustrates the load ring 212 including the hanger side profile 216 and the housing side profile 218. It should be appreciated that various components are shown for illustrative purposes only and that different adjustments may be made while still remaining within the scope of the present disclosure. For example, in the illustrated embodiment, the respective grooves 226, 256 may be pointed and/or have rounded edges. As an example, the illustrated load ring housing side grooves 256 have rounded edges, while the load ring housing side grooves 226 have pointed edges at the peaks.

The hanger side grooves 226 include the upstream face 236 and the downstream face 238. In the illustrated embodiment, the upstream face 236 is arranged at a first angle 500 and the downstream face 238 is arranged at a second angle 502. Accordingly, a groove gap angle 504 is formed between adjacent upstream and downstream faces 236, 238. Each of the angles 500, 502, 504 may be adjusted in order to modify how loads are transmitted throughout the system, and it should be appreciated that associated angles, such as those of the hanger or the housing, may be adjusted accordingly. For example, as described, increasing the first angle 500 may facilitate greater outward radial forces responsive to an upward force applied to the load ring 212. That is, the larger angle may transmit forces between a vertical component and a horizontal component of the force vector. Similar adjustments to the angles 502, 504 may also modify how forces are distributed between various components.

The illustrated load ring 212 further includes the housing side profile 218 having the housing side profile grooves 248. As noted above, while the grooves 248 may be illustrated as having rounded edges along the peaks, in other embodiments the grooves 248 may be pointed, or some of the grooves 248 may have peaks that are pointed while others are rounded. The grooves 248 include an upper face 260 and a lower face 262. The upper face 260 is arranged at a third angle 506 and the lower face 262 is arranged at a fourth angle 508. As a result, a groove angle 510 is formed between the upper and lower faces 260, 262. In embodiments, each of the angles 506, 508, 510 may be adjusted based on operating conditions. For example, the angles 506, 508 may be substantially equal to one another. However, in other embodiments, the angles 506, 508 may be different. Additionally, individual grooves 224, 248 may have different angles, shapes, and the like. Accordingly, the load ring 212 may be adjusted to accommodate a variety of different operating scenarios.

The load ring 212 further includes a driven surface 512 that interacts with the plunger 204. The driven surface 512 is arranged at a fifth angle 514, which may be adjusted based on a variety of factors, as explained above. For example, the angle 514 may be adjusted in order to generate a greater percentage of the force in an upward direction. Accordingly, as noted above, different features of the load ring 212 may be adjusted based on operating conditions.

Figure 6:
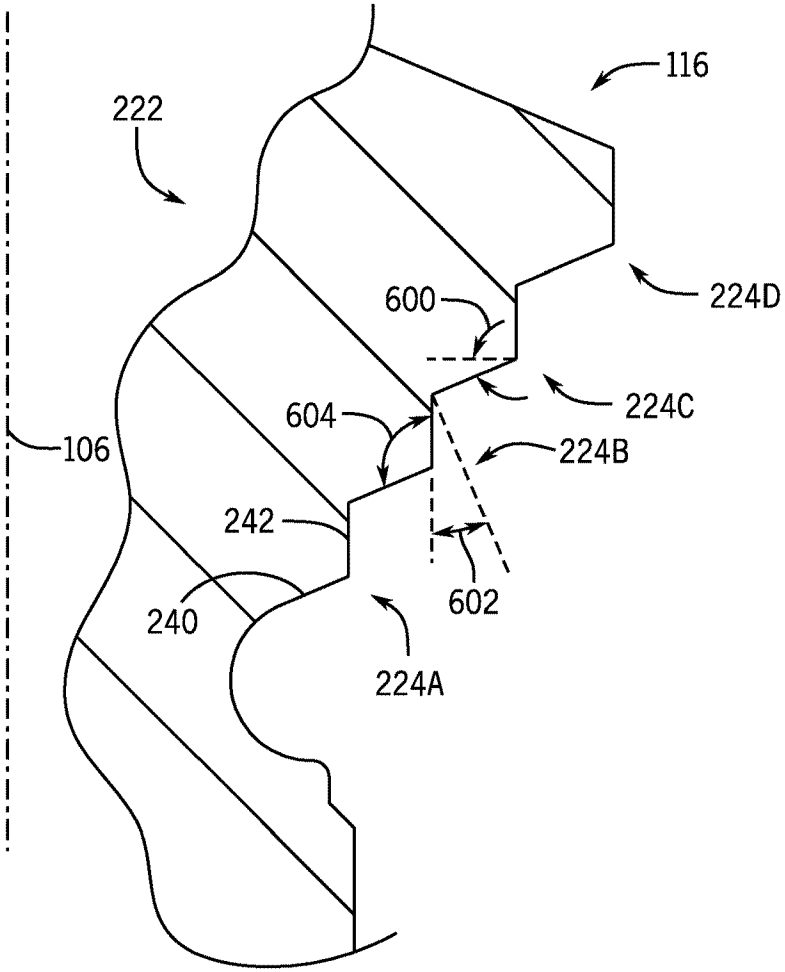
FIG. 6 is a schematic cross-sectional view of an embodiment of a hanger profile, in accordance with embodiments of the present disclosure.

FIG. 6 is a cross-sectional side view of the hanger profile 222 that includes the hanger profile grooves 224. Each of the hanger profile grooves 224 include the slanted portion 240 and the planar portion 242. As shown, the slanted portion 240 is arranged at a sixth angle 600 while the planar portion 242 is arranged at a seventh angle 602. The grooves 224 also each include a hanger groove angle 604. As noted above with respect to the load ring 212, each of the angles 600, 602, 604 may be adjusted based on operating conditions and/or to accommodate adjustments to the load ring 212. In this manner, force distribution may be controlled.

Figure 7:
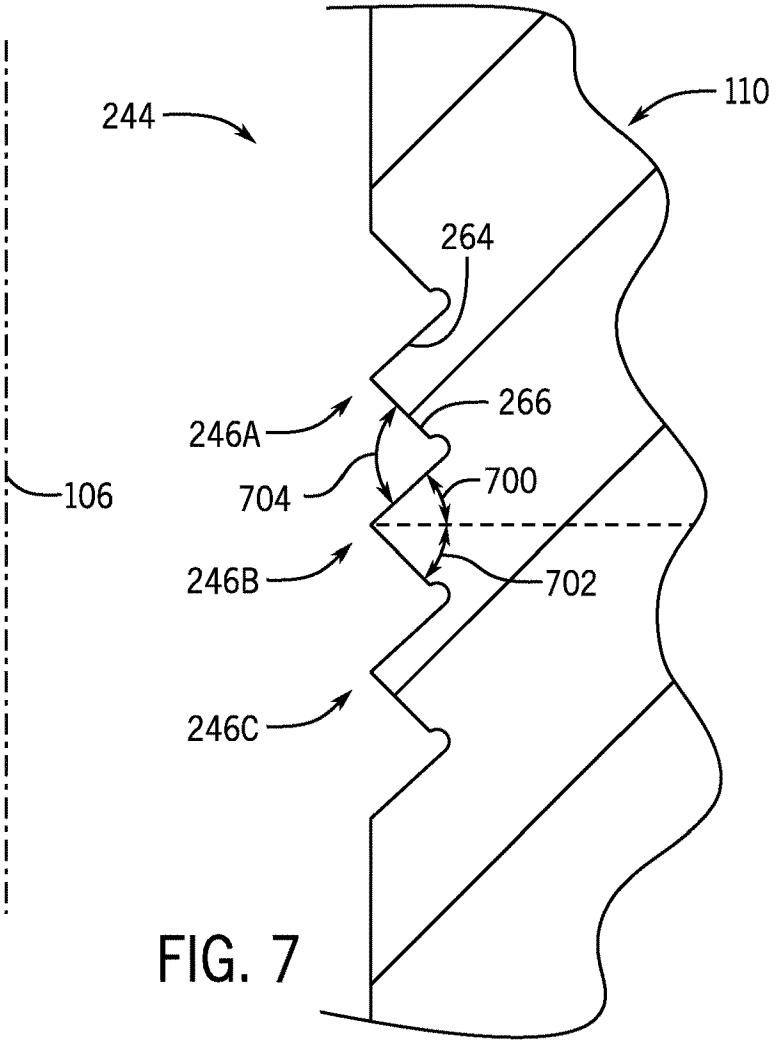
FIG. 7 is a schematic cross-sectional view of an embodiment of a housing profile, in accordance with embodiments of the present disclosure.

FIG. 7 is a cross-sectional side view of the housing profile 244 that includes the housing profile grooves 246. Each of the housing profile grooves 244 include the upper portion 264 and the lower portion 266. As shown, the upper portion 264 is arranged at an eighth angle 700 while the lower portion 266 is arranged at a ninth angle 702. The grooves 246 also each include a housing gap angle 704. As noted above with respect to the load ring 212, each of the angles 700, 702, 704 may be adjusted based on operating conditions and/or to accommodate adjustments to the load ring 212. In this manner, force distribution may be controlled.

Figure 8:
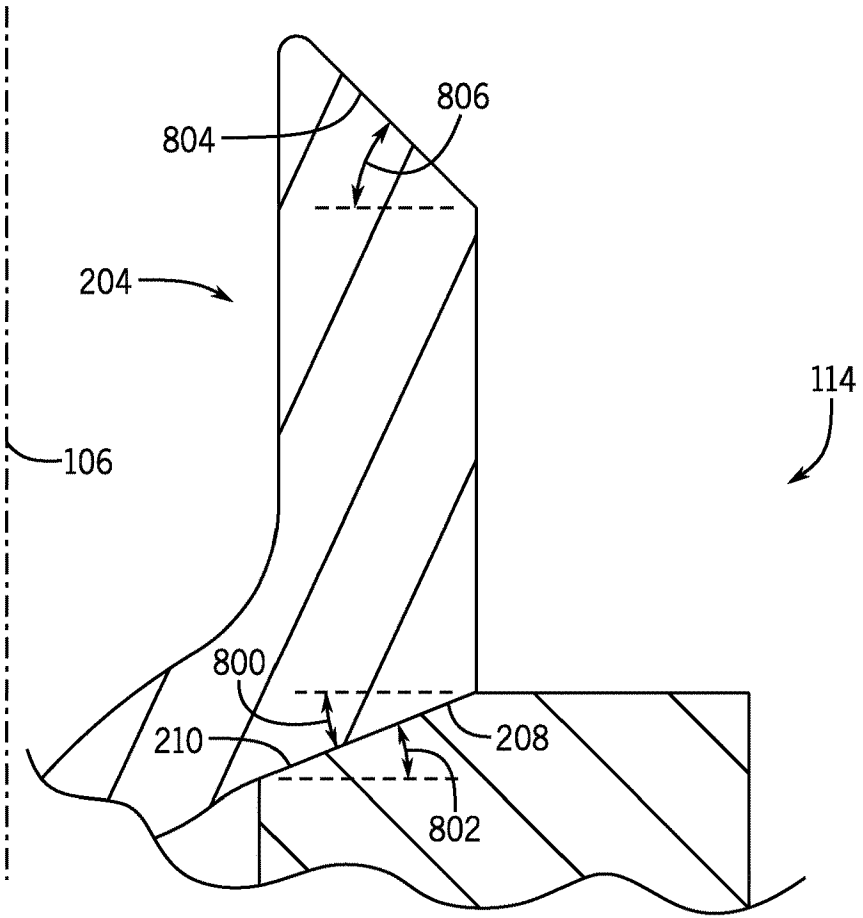
FIG. 8 is a schematic cross-sectional view of an embodiment of a plunger engaged with a first position casing hanger, in accordance with embodiments of the present disclosure.

FIG. 8 is a cross-sectional view of an embodiment of the plunger 204 interacting with the first position casing hanger 114. In the illustrated embodiment, an activation surface 210 of the plunger 204 contacts a slanted portion 208 of the first position casing hanger 114. The illustrated activation surface 210 is arranged at a tenth angle 800 and the slanted portion 208 is at a corresponding eleventh angle 802. In various embodiments, the tenth and eleventh angles 800, 802 may be particularly selected to adjust a force output from the plunger 204, however, in various embodiments, one or more of the angles 800, 802 may be dependent on certain associated equipment. For example, smaller angles may generate a larger vertical force. The plunger 204 also includes a contact surface 804 arranged to engage the driven surface 512 of the load ring 212. The contact surface 804 is positioned at the twelfth angle 806. As described, in various embodiments, the twelfth angle 806 may be adjusted to change operational parameters of the system. The twelfth angle 806 may affect both load distribution and motion of with respect to the load ring 212, as described above.

Figure 9:
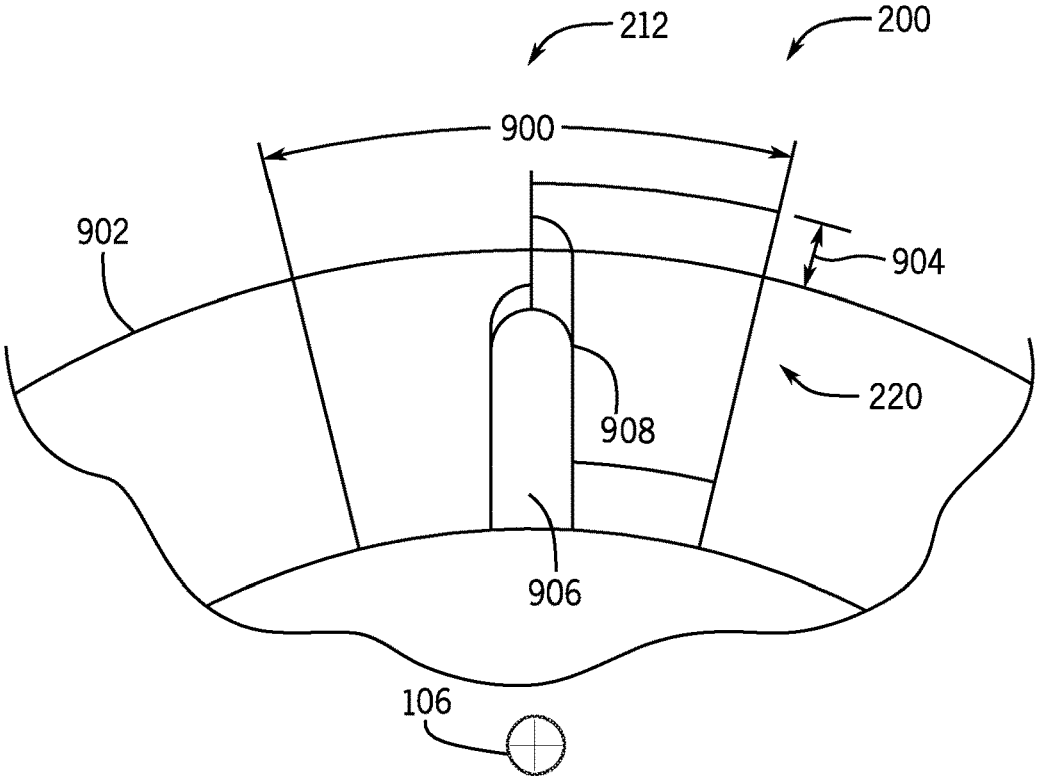
FIG. 9 is a schematic cross-sectional top view of an embodiment of a load ring, in accordance with embodiments of the present disclosure.

FIG. 9 is a cross-sectional top view of an embodiment of a portion of the actuated load shoulder 200 in which the load ring 212 is illustrated in a retracted position (left side) and an activated position (right side). It should be appreciated that, in various embodiments, load ring 212 may be a segmented ring, as illustrated in FIG. 9, and as a result, the load ring 212 may have a circumferential distance 900, which is less than a circumference of the second position casing hanger 116. In embodiments, there may be a plurality of segments arranged circumferentially about the second position casing hanger 116. For example, in embodiments, there may be approximately 12 segments, but it should be appreciated that there may be more or fewer segments.

The load ring 212 is arranged within the pocket 220 and, in the retracted position, is arranged substantially flush with an outer diameter 902 of the second position casing hanger 116. In an activated position, however, the load ring 212 extends radially out from the outer diameter 902, for example, by a radial distance 904. The radial distance 904 may represent a distance, extending radially outward from the hanger, that the load ring 212 extends in order to, for example, engage the housing. Radial movement of the load ring 212 enables easy installation within the well bore.

As shown in FIG. 9, the load ring 212 includes a relief cut 906 which includes a retainer 908, which may be used to facilitate movement of the load ring 212. The retainer 908 may also support the load ring axially 212, for example, to block downward movement of the load ring 212 (e.g., into the plane of the page).

Figure 10:
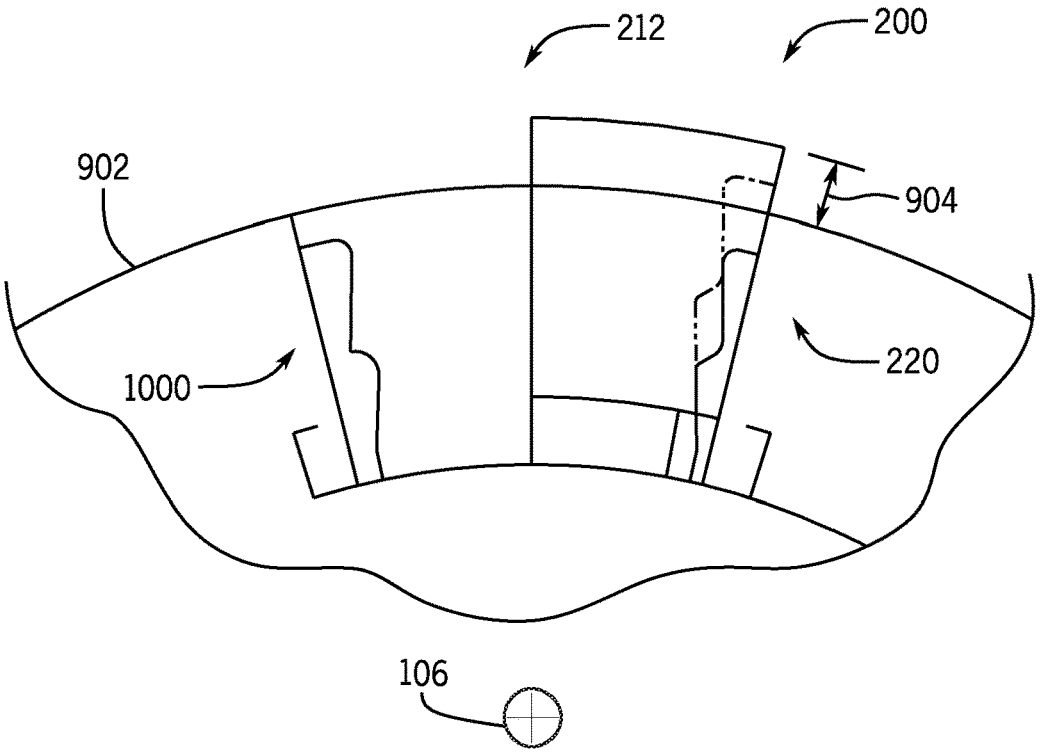
FIG. 10 is a schematic cross-sectional top view of an embodiment of a load ring, in accordance with embodiments of the present disclosure.

FIG. 10 is a cross-sectional top view of an embodiment of a portion of the actuated load shoulder 200 in which the load ring 212 is illustrated in a retracted position (left side) and an activated position (right side). The load ring 212 is arranged within the pocket 220 and, in the retracted position, is arranged substantially flush with the outer diameter 902 of the second position casing hanger 116. In an activated position, however, the load ring 212 extends radially out from the outer diameter 902, for example, by the radial distance 904. Radial movement of the load ring 212 enables easy installation within the well bore, as noted above.

Figure 11:
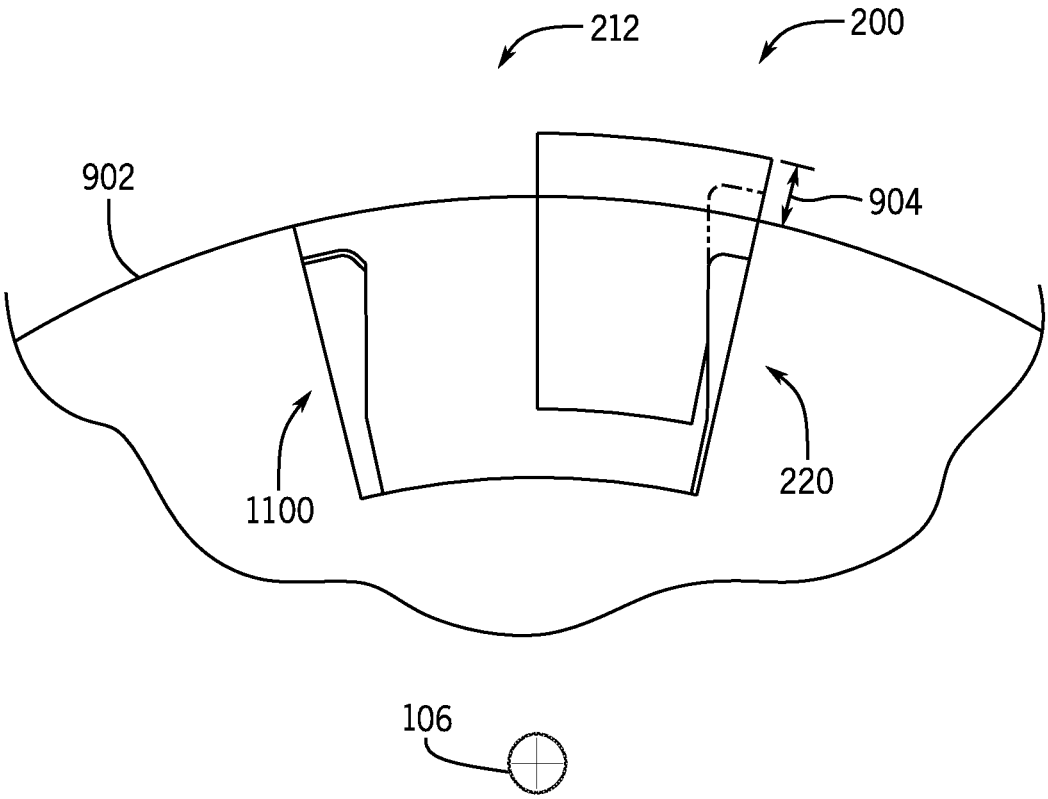
FIG. 11 is a schematic cross-sectional top view of an embodiment of a load ring, in accordance with embodiments of the present disclosure.

The illustrated embodiment includes a double shoulder 1000 to help smooth out movement of the load ring 212. FIG. 11 is a cross-sectional top view of an embodiment of a portion of the actuated load shoulder 200 in which the load ring 212 is illustrated in a retracted position (left side) and an activated position (right side). The load ring 212 is arranged within the pocket 220 and, in the retracted position, is arranged substantially flush with the outer diameter 902 of the second position casing hanger 116. In an activated position, however, the load ring 212 extends radially out from the outer diameter 902, for example, by the radial distance 904. Radial movement of the load ring 212 enables easy installation within the well bore, as noted above. FIG. 11 includes a single shoulder 1100 for smoothing out movement of the load ring 212.

Furthermore, embodiments illustrated in FIG. 9-11 may also include a biasing force or member to drive the load ring 212 radially inward to the pocket 220. For example, a spring or other biasing device may be utilized to drive the load ring 212 into the pocket 220. In embodiments, the biasing force may be particularly selected to be sufficient in situations where the plunger 204 is not acting on the loading ring 212.

Figure 12:
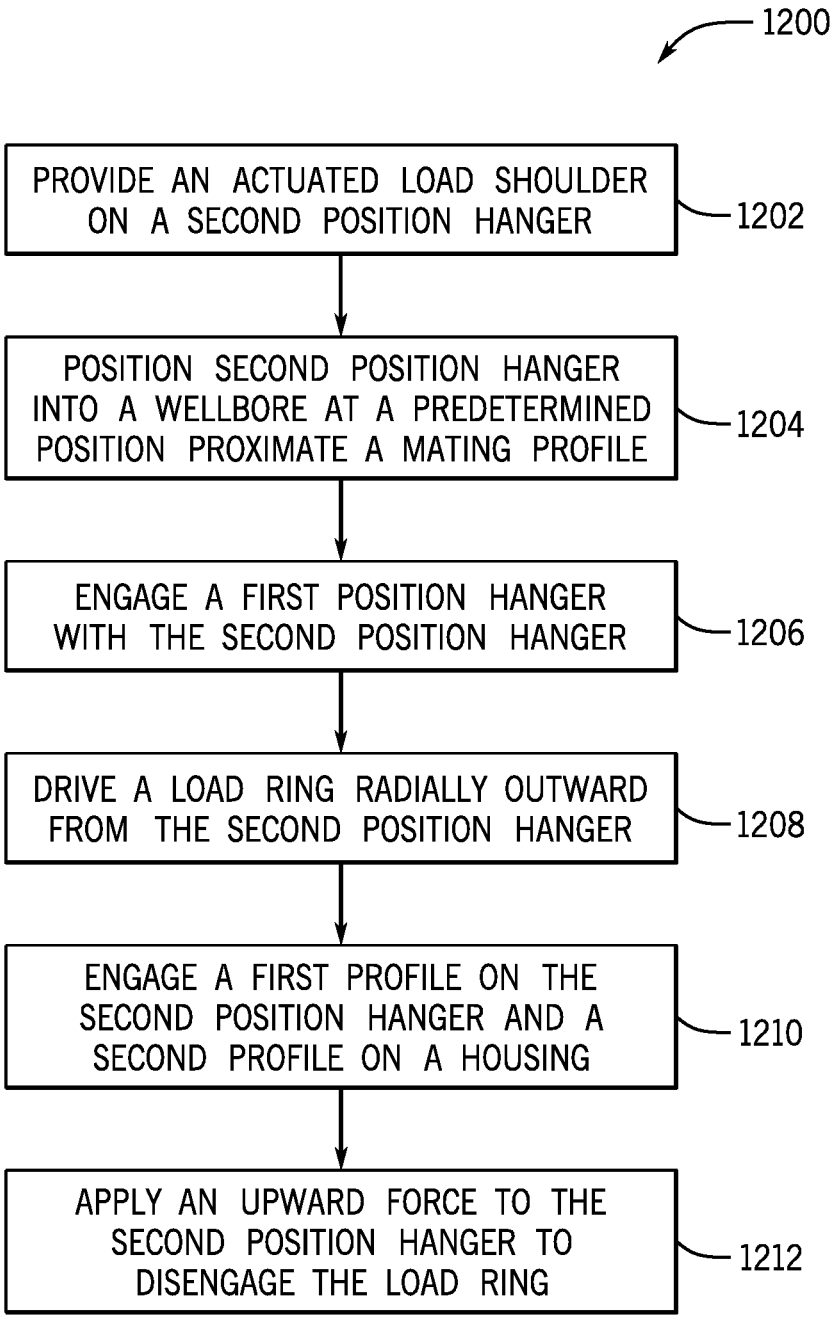
FIG. 12 is a flow chart of an embodiment of a method to deploy an actuated load shoulder, in accordance with embodiments of the present disclosure.

FIG. 12 illustrates a flow chart of an embodiment of a method 1200 for preparing and deploying a downhole tool/hanger that includes an actuated load shoulder. It should be appreciated for this method and all methods described herein that the steps may be performed in any order, or in parallel, unless otherwise explicitly stated. Moreover, there may be more or fewer steps and certain steps may be omitted, in certain embodiments. In this example, an actuated load shoulder is installed on a downhole tool, such as a second position hanger 1202. As described above, in various embodiments the actuated load shoulder is arranged within a pocket of the second position hanger and one or more components, such as a plunger, may be coupled to the second position hanger. In various embodiments, the second position hanger includes a pocket receiving the actuated load shoulder, which may include a load ring that is segmented. The second position hanger is tripped into the wellbore and positioned proximate a mating profile 1204. In embodiments, the mating profile is formed in a high pressure housing. However, it should be appreciated that in certain embodiments the profile in the high pressure housing may be omitted. The second position hanger engages a first position hanger 1206. For example, the second position hanger may land on a shoulder of the first position hanger. A load ring is then driven radially outward from the second position hanger 1208. The load ring may be a portion of the actuated load shoulder and may receive a force from a plunger that contacts the first position hanger. The plunger may transmit an upward reaction force, that is opposite to the casing weight, which drives the load ring along a hanger profile in an upward and radially outward direction relative to the hanger, as the hanger continues to move in the downward direction. The load ring may engage one or more profiles 1210. For example, the load ring may engage a second position hanger profile and a housing profile. In certain embodiments, the load ring may engage only one of the profiles. Upon engagement of the profiles, the force from the second position hanger, for example due to the weight, may be distributed between both the first position hanger and the high pressure housing. Advantageously, this reduces the load on the first position hanger, unlike traditional systems. To remove the second position hanger, an upward force may be applied to disengage the load ring 1212. The upward force may be an upward reaction force that is opposite the weight that is applied downward and may remove the force from the plunger, which may enable the load ring to move radially inward toward the second position hanger.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellhead system comprising:

a first position casing hanger, arranged within a wellbore, the first position casing hanger supported, at least in part, by a load member;

a second position casing hanger, arranged within the wellbore, the second position casing hanger positioned axially higher and stacked on the first position casing hanger, a weight of the second position casing hanger supported, at least in part and less than entirely, by the first position casing hanger and, at least in part, by an actuated load shoulder absent contact between the first position casing hanger and the second position casing hanger, the actuated load shoulder transferring a force into a high pressure housing, the actuated load shoulder comprising a load ring having a hanger side profile and a housing side profile, the load ring adapted to engage a hanger profile formed in the second position casing hanger and a housing profile formed in the high pressure housing upon activation via the first position casing hanger, the load ring being driven toward the high pressure housing via a force applied to a contact surface arranged at a first angle, the force driving the load ring toward the hanger profile along a hanger groove arranged at a hanger groove angle, wherein the first angle is less than a housing groove angle of the housing profile.

2. The wellhead system of claim 1, further comprising:

a plunger coupled to the second position casing hanger in a retracted position and adapted to move relative to the second position casing hanger in an activated position, the plunger arranged between the load ring and the first position casing hanger to transmit the force to the load ring.

3. The wellhead system of claim 1, wherein the hanger side profile comprises a plurality of hanger side grooves, each groove of the hanger side profile including an upstream face and a downstream face, the upstream face positioned at a first hanger side groove angle and the downstream face positioned at a second hanger side groove angle.

4. The wellhead system of claim 3, wherein the hanger profile comprises a plurality of hanger grooves, each groove of the hanger profile including a slanted portion arranged at the hanger groove angle, wherein each hanger groove angle is shallower than the housing groove angle.

5. The wellhead system of claim 1, wherein the housing side profile comprises a plurality of housing side grooves, each groove of the housing side profile grooves including an upper face and a lower face, the upper face positioned at a first housing side groove angle and the lower face positioned at a second housing side groove angle.

6. The wellhead system of claim 5, wherein the housing profile comprises a plurality of housing profile grooves, each groves of the housing profile grooves including an upper portion arranged at a first housing groove angle and a lower portion arranged at a second housing groove angle, the respective upper portions aligning with the respective upper faces when the housing side profile contacts the housing profile.

7. The wellhead system of claim 1, wherein the first angle, the hanger groove angle, and the housing groove angle are particularly selected to overcome an inward radial reaction force produced by the housing, the first angle being downwardly sloped toward the high pressure housing.

8. The wellhead system of claim 1, wherein the load ring moves radially outward from a retracted position where the load ring is not in contact with the housing to an activated position where the load ring is in contact with the housing.

9. The wellhead system of claim 1, wherein the load ring is segmented, the second position hanger including a plurality of load ring segments.

10. A wellhead system, comprising:

a housing positioned within a wellbore, the housing including a housing profile formed, at least in part, by a plurality of housing profile grooves;

a first position casing hanger, arranged within a wellbore, the first position casing hanger supported, at least in part, by a load member;

a second position casing hanger, arranged within the wellbore, the second position casing hanger positioned axially higher and stacked on the first position casing hanger, the second position casing hanger including a hanger profile formed, at least in part, by a plurality of hanger profile grooves;

a load ring adapted to move radially outward from the second position casing hanger, the load ring comprising:

a hanger side profile having a plurality of hanger side profile grooves, at least a portion of the hanger side profile grooves aligning with at least a portion of the hanger profile grooves;

a housing side profile having a plurality of housing side profile grooves, at least a portion of the housing side profile grooves aligning with at least a portion of the housing profile grooves when the load ring is in an activated position; and a contact surface positioned at a lower region of the load ring, the contact surface arranged at a contact surface angle, the contact surface angle adapted to receive a reaction force based least in part, on downward movement of the second position casing hanger, relative to the first position casing hanger;

wherein at least a portion, but less than an entirety, of a weight of the second profile casing hanger is supported by the housing when the load ring is in the activated position, the load ring being moved into the activated position via engagement between the first position casing hanger and the second position casing hanger, absent contact between the first position casing hanger and the second position casing hanger, the contact surface receiving the reaction force and driving movement of the load ring in an axial direction toward the hanger grooves arranged at respective hanger groove angles and radially toward the housing profile, the housing profile grooves arranged at respective housing groove angles greater than the contact surface angle.

11. The wellhead system of claim 10, wherein each groove of the hanger side profile grooves includes an upstream face at a first angle and each groove of the housing side profile grooves includes an upper face at a second angle, the first angle being different from the second angle.

12. The wellhead system of claim 11, wherein at least one of the first angle or the second angle is selected to increase a proportion of the weight of the second profile casing hanger transmitted to the housing.

13. The wellhead system of claim 10, wherein the load ring moves radially outward and axially upward, relative to the second position casing hanger, in the activated position.

14. The wellhead system of claim 10, further comprising:

a plunger coupled to the second position casing hanger in a retracted position and adapted to move relative to the second position casing hanger in an activated position, the plunger arranged between the load ring and the first position casing hanger to transmit the reaction force to the load ring via the contact surface.

15. The wellhead system claim 14, wherein the contact surface angle, the hanger groove angle, and the housing groove angle are particularly selected to overcome an inward radial reaction force produced by the housing, the contact surface angle being downwardly sloped away from the second position casing hanger.

16. The wellhead system of claim 14, wherein the plunger is secured to the second position casing hanger via a shear pin, the shear pin breaking to facilitate movement between the plunger and the second position casing hanger when acted on by a force exceeding a threshold.

17. A method for arranging a stacked hanger configuration, comprising:

providing a second position casing hanger having an actuated load shoulder, the actuated load shoulder including a load ring that moves between a retracted position and an activated position;

positioning the second position casing hanger, within a wellbore, proximate a housing profile formed in a high pressure housing, the second position casing hanger being axially uphole from a first position casing hanger;

engaging a shoulder of the first position casing hanger, via the second position casing hanger and absent contact between the first position casing hanger and the second position casing hanger, to drive the load ring radially outward from the second position casing hanger, the load ring receiving a driving force along an angled contact surface; and engaging the housing profile, via the load ring, when the load ring is in the activated position.

18. The method of claim 17, further comprising:

applying an upward force to the second position casing hanger, the upward force moving the load ring to the retracted position; and removing the second position casing hanger from the wellbore.

19. The method of claim 17, wherein the housing does not include a load shoulder to move the load ring to the activated position.

20. The method of claim 17, further comprising:

supporting at least a portion of a weight of the second position casing hanger via the first position casing hanger; and supporting at least a portion of the weight of the second position casing hanger via the housing.

* * * * *